US006771181B1

(12) United States Patent
Hughen, Jr.

(10) Patent No.: US 6,771,181 B1
(45) Date of Patent: Aug. 3, 2004

(54) CRAWL TO THE LIGHT EMERGENCY EXIT

(76) Inventor: Otis L. Hughen, Jr., Rte. 1, P.O. Box 68G, Vici, OK (US) 73859

( * ) Notice: Subject to any disclaimer, the term of this patent is extended or adjusted under 35 U.S.C. 154(b) by 0 days.

(21) Appl. No.: 09/782,224

(22) Filed: Feb. 14, 2001

(51) Int. Cl.[7] ..... G08B 23/00

(52) U.S. Cl. ..... 340/693.5; 340/326; 340/584; 340/628; 340/693.2; 340/691.1; 49/141; 52/127.8; 182/18; 182/76

(58) Field of Search ..... 340/332, 333, 340/577, 578, 579, 584, 628, 629, 630, 632, 693.2, 693.5, 326; 379/40, 41, 45; 182/18, 76; 49/225, 141; 52/127.8

(56) References Cited

U.S. PATENT DOCUMENTS 4,283,657 A * 8/1981 Gordon et al. ..... 340/628
4,539,555 A * 9/1985 Tefka ..... 340/500
4,679,365 A * 7/1987 Herring ..... 49/141
4,736,144 A 4/1988 Chun-Pu ..... 318/467
4,763,115 A * 8/1988 Cota ..... 340/628
4,819,378 A * 4/1989 Ando ..... 49/225
4,824,150 A 4/1989 Smith et al. ..... 292/92
4,919,235 A * 4/1990 DelSavio ..... 182/18
4,937,556 A * 6/1990 Scott et al. ..... 340/686.1
5,255,479 A * 10/1993 Shepherd ..... 52/127.8
5,309,863 A 5/1994 Leeb, Jr. ..... 116/205
5,479,151 A * 12/1995 Lavelle et al. ..... 340/542
RE35,268 E * 6/1996 Frolov et al. ..... 340/545
5,527,074 A 6/1996 Yeh ..... 292/177
5,552,766 A * 9/1996 Lee et al. ..... 340/541
5,886,637 A 3/1999 Stuckey ..... 340/628
5,894,906 A 4/1999 Weber ..... 180/274
6,102,155 A * 8/2000 Hood et al. ..... 182/76
6,249,221 B1 * 6/2001 Reed ..... 340/539
6,318,296 B1 * 11/2001 Nguyen ..... 119/502

* cited by examiner

*Primary Examiner*—Benjamin C. Lee
(74) *Attorney, Agent, or Firm*—Rothwell, Figg, Ernst & Manbeck

(57) ABSTRACT

The present application provides a new emergency exit system. The system comprises an exit door controlled by an emergency detection system, which includes emergency detection sensors such as a smoke detector, a heat detector and/or a carbon monoxide detector functionally connected to the door. The exit door is pivotally mounted on a frame and equipped with a locking mechanism which is in communication with the emergency detection system through an alarm system. The door automatically opens and illuminates when an unsafe emergency situation is detected to provide a lighted escape route at the floor level of a room.

20 Claims, 2 Drawing Sheets

CRAWL TO THE LIGHT EMERGENCY EXIT

BACKGROUND OF THE INVENTION

1. Field of the Invention

The present invention relates to an emergency exit door that is activated by an emergency detection system. The door provides a ready route from a room in a building such as a residential house or apartment to the outside without crawling through the burning building to locate an exit door. The door also offers ready access to individual rooms in a house or apartment if doorways and halls are blocked by fire and smoke. Preferably the emergency exit door is connected to an alarm system that can be programmed to automatically alert the fire department when a fire is detected.

2. Brief Description of the Related Art

Emergency situations involving fire can create panic and confusion. Individuals in a burning building, particularly young children and the elderly, quickly become disoriented and can become lost inside a smoked filled room, particulary at night when the room is dark. Additionally, both adults and children can become trapped in smoke filled rooms where doors are too hot or too difficult to open. Individuals are often trapped in rooms a great distance from an exit, making it difficult for rescue personnel to reach them.

Fire alarms are helpful in alerting individuals to emergency situations such, as fire, but can add to the confusion during an escape. Exit doors that trigger alarms as someone exits the building are known in the art. Signs or markers position to direct individuals towards an exit route are also known. However, such devices are rarely, if ever, used in residential homes.

Typically residential homes rely on small, battery powered smoke detectors to alert individuals in the homes of the presence of smoke and fire. These detectors only provide an alarm. Individuals are left to respond to the emergency signals and locate a safe exit route from an unsafe house, apartment or other building. Exit routes through residential buildings often require individuals to move significant distances through dark, smoke-filled rooms and hallways to reach exit doors or to breakout glass in bedroom windows, risking dangerous cuts and other injuries. People often become disoriented or confused when responding to emergency alarms, particularly when the emergency situation occurs at night, when people are sleeping.

During a fire, doors along an escape route may be blocked by burning material or debris from the fire so that the doors cannot be opened. Additionally, opening doors to escape hallways where a fire is burning can cause the fire to spread to other areas of the building and can trap those trying to escape. Broken glass makes exiting through windows dangerous. Thus, there is a need for an economical, efficient emergency exit door adapted for residential use, particular for residential dwellings such as single family houses, townhouses and apartments. The present invention provides an escape door designed for residential use that aids the occupants of the dwelling in finding a safe, close exit from a burning building.

SUMMARY OF THE INVENTION

The invention of the present application provides an emergency exit system for residential dwellings which can detect emergency situations in a building, alert people in the dwelling of the emergency and automatically open a safe escape door. The emergency exit unit includes alarm circuitry in communication with one or more emergency detection sensors, and an escape door. The door is preferably pivotally mounted on a frame so that it can open to the outside. Optionally the door can open into the room in which it is located. The escape door is equipped with locking mechanism that is automatically unlocked in response to a signal indicating the presence of a fire, smoke or other dangerous situation, such as the presence of elevated levels of carbon monoxide. The alarm signal may be broadcast through one or more speakers mounted in the door itself, in the frame surrounding the door, or in a sensor mount away from the unit, but being in communication with the unit to provide an alarm to alert the occupants of the building to the presence of unsafe or dangerous conditions in the building. One or more lights, which are controlled by the alarm circuitry may also be incorporated into the system to provide illumination to direct individuals, particularly small children to the escape door.

In a preferred embodiment, the emergency exit device includes an escape door that can be installed in a wall. Preferably, the escape door structure is located in an exterior wall, at or just above floor level. By installing the escape door near the floor level, individuals can see and access the door while crawling on the floor thereby minimizing the inhalation of smoke. Installation of the exit door in an exterior wall provides a direct exit route to the outside of the building.

The lights and speakers of the emergency detection and alert system are preferably incorporated into the escape door structure. The lights are preferably housed in the door frame or door so that during an emergency an individual can see the escape door easily. The speakers are preferably housed in the door frame or door as well, so that an alarm sounding from the speakers will direct individuals to the escape door.

Preferably, the emergency detection sensors detect smoke, carbon monoxide and/or fire. The emergency detection sensors are preferably located at some location above the escape door structure, and are in communication with the alarm circuitry and the escape door structure. Smoke and heat rise and can therefore generally be detected sooner at a location above the escape door structure.

In a preferred method of operation, the emergency detection sensors detect the presence of smoke, carbon monoxide or fire. The detection sensors preferably communicate with the alarm circuitry, and consequently with the speakers, the lights, and the locking and unlocking mechanism of the escape door structure. Preferably, the speakers sound an alarm, the lights are illuminated, and the escape door is unlocked simultaneously. The automatic opening mechanism of the escape door structure preferably acts to open the escape door automatically, creating a safe escape exit.

Additionally, the emergency exit device can preferably be equipped with other features including, but not limited to, a power supply, an escape rope or ladder, a manual unlocking and opening mechanism, an automated dialing feature to contact emergency personnel, and fabricated interior and exterior surfaces to resemble the wall surfaces. Emergency exit devices can preferably be installed in various locations in a building and be in communication with one another. Multiple emergency exit devices can preferably be monitored or controlled at a central location by the use of a key pad.

The features and advantages of the present invention will become more apparent in view of the figures and the detailed description which follow.

DESCRIPTION OF THE PREFERRED EMBODIMENTS

One preferred embodiment of the invention is an emergency exit device, comprising an emergency detection and alert system and an escape door structure.

Figure 1:
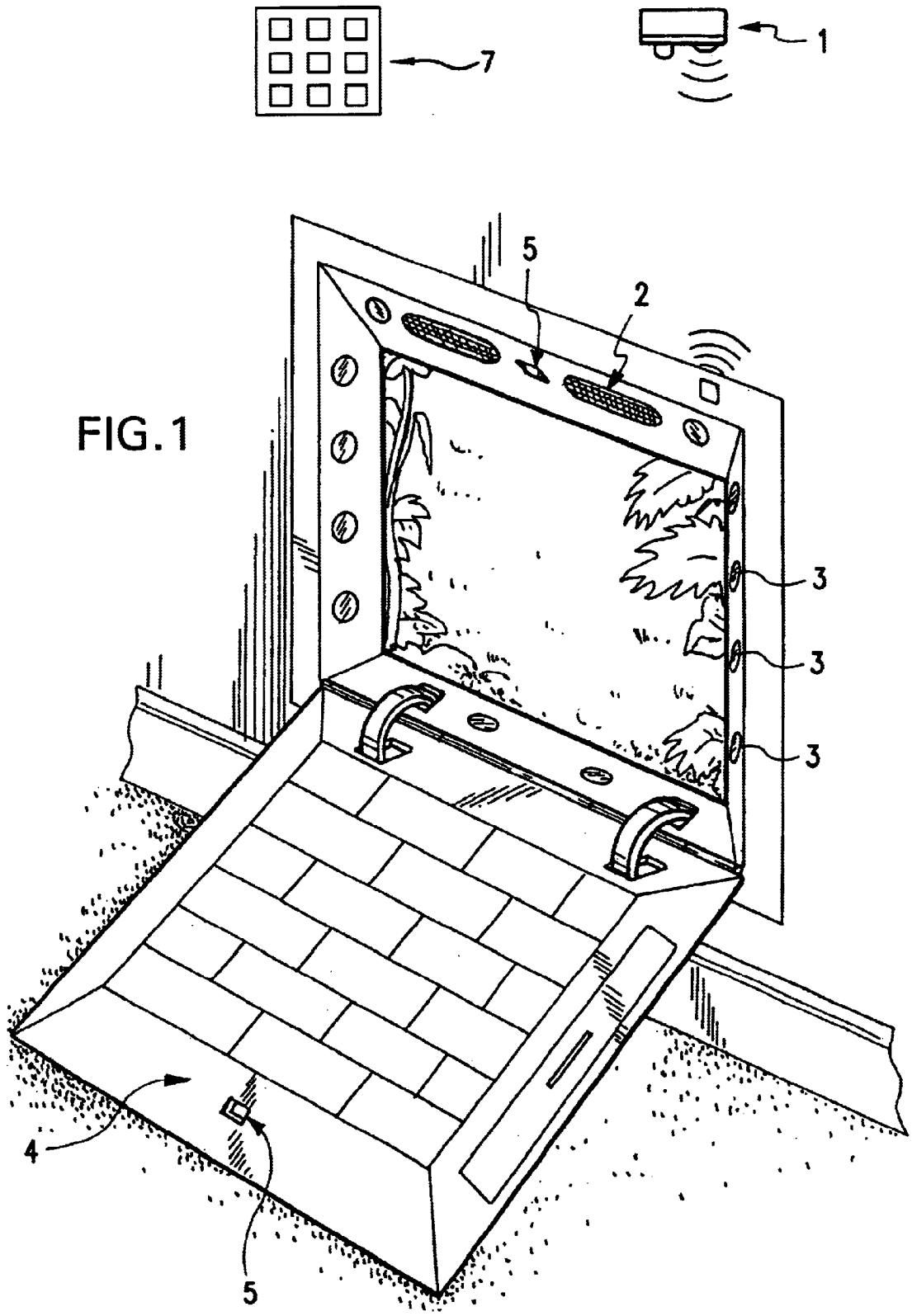
FIG. 1 is a perspective view of one embodiment of the emergency exit door.
Figure 2:
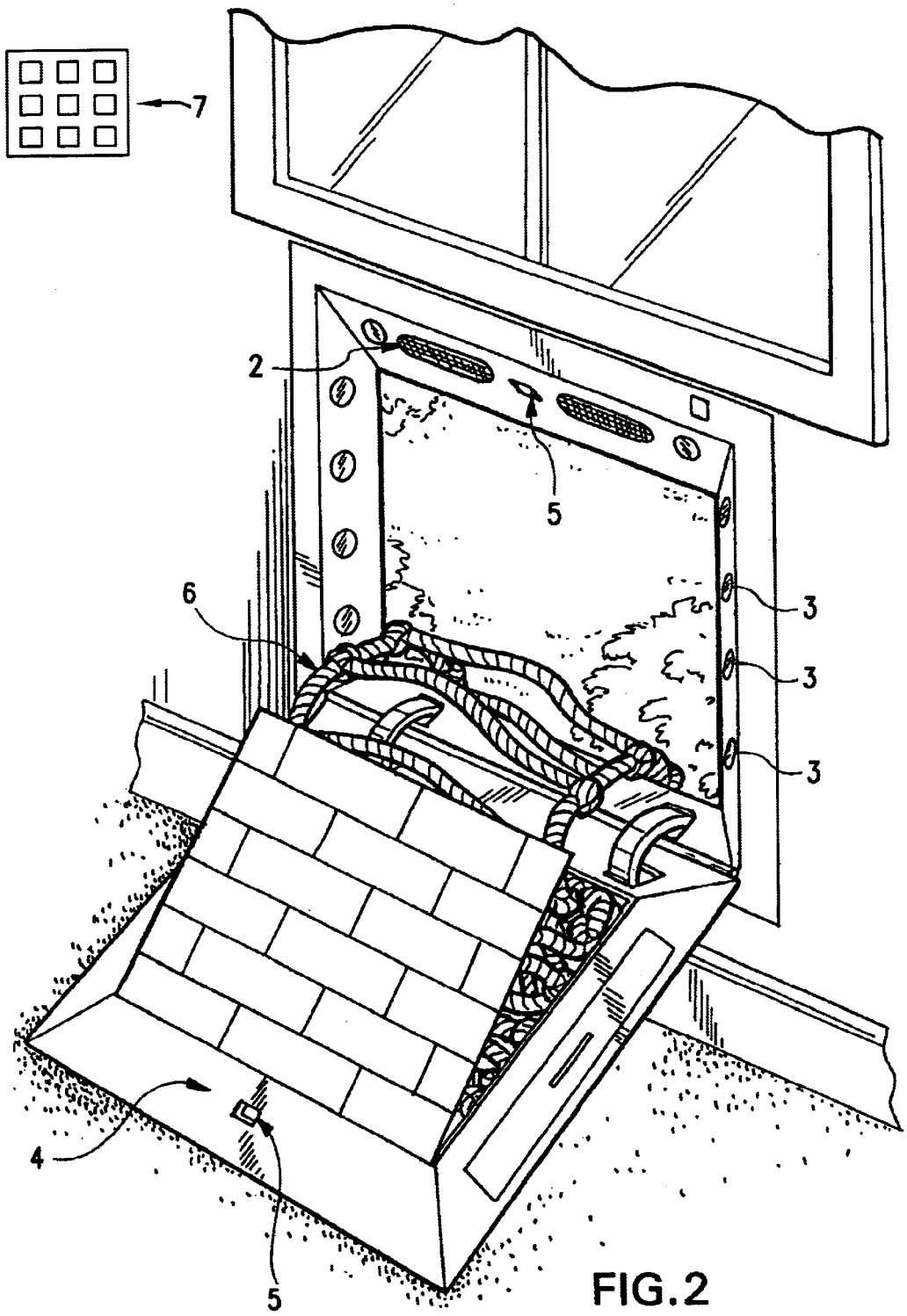
FIG. 2 is a perspective view of a second embodiment of the emergency exit door having an optional rope ladder to facilitate exit from rooms in structures that are above ground level.

As illustrated in FIGS. 1 and 2 he emergency detection and alert system preferably comprises alarm circuitry in communication with one or more emergency detection sensors 1, one or more speakers 2, and one or more lights 3.

The escape door structure preferably comprises a door 4 pivotally mounted on a door frame, wherein the escape door unit is equipped with an automatic locking and unlocking mechanism 5 that is in communication with the alarm circuitry, and wherein the escape door structure is equipped with an automatic opening mechanism. A key pad 7 can be used to control multiple emergency exit devices.

The escape door unit is installed in a wall. Preferably, the escape door unit is located in a lower portion of an exterior wall. Alternatively, the door unit can be installed in other locations or in interior walls. The door is preferably installed during construction of the wall. Alternatively, the emergency door system can be added to a wall later as a new door during remodeling. Another embodiment of the invention comprises mounting the escape door unit below a window on an exterior wall as a unit. The window and escape door unit are preferably one unit that can be installed into a wall.

When installed near the ground level, the escape door unit can be seen and accessed by an individual crawling on the floor to avoid inhaling smoke. An exterior wall is preferred so that an individual can exit the building directly rather than travel through an interior escape route which may be hazardous. The likelihood that the individual will encounter physical obstacles or dangerous conditions along an escape route is greatly reduced if the individual's escape route to the outside is a short path directly through an exterior wall.

The door frame of the escape door system is preferably secured in the wall using traditional means. The door is preferably shaped to be compatible with the door frame and is preferably secured to the door by a hinge or similar means. The door is shown in FIG. 1 opening downward and into the room. However, the location of the hinge or similar securing means may be changed such that the door opens to the side, upward, or outward instead.

The door can be attached to the door frame by chains or other supporting devices so that the door can serve as a platform when it is mounted so that it opens outside of the room. This embodiment of the invention could be desired for units to be installed in an upper floor bedroom of a house, apartment or other building.

Preferably, the emergency detection sensors detect smoke, carbon monoxide, heat or fire. The detection sensors are preferably sensors known to those of skill in the art. Alternatively, the sensors could be any other type of sensor that may be useful in detecting an emergency. A motion sensor, for example, may be useful for detecting an earthquake or bomb blast.

The emergency detection sensors are preferably located at a location above the escape door structure. Smoke and heat rise and can therefore generally be detected sooner at a location above the escape door structure. Alternatively, the sensors could be housed in the door or door frame, or in some location other than above the escape door structure.

The emergency detection sensors are preferably in communication with the alarm circuitry and a signal is sent when an emergency is detected using alarm circuitry known to those of skill in that art. Wires or other means of transferring signals are preferably used to communicate. Infrared signals, for example, may be used to communicate between some elements of the emergency detection and alert system as an alternative to using wires. Additionally, the alarm circuitry is a preferable means of communication between the elements of the emergency exit system. Other means of communication that are familiar in the art are acceptable alternatives.

The lights of the emergency detection and alert system are preferably incorporated into the escape door structure. The lights are preferably housed in the door frame or door so that during an emergency an individual can see the escape door easily. Preferably, the lights are inset into the door frame and are only visible when the door is open. The lights are preferably high intensity lights. Preferably, there are multiple lights arranged around the door frame, forming a "target" to head toward in a smoke filled room. The lights in the door or door frame provide orientation for persons during an emergency situation. Even small children can be taught to crawl toward the light in an emergency. The lights are preferably in communication with the alarm circuitry and are turned on when an emergency is detected.

The emergency detection and alert system preferably includes speakers which emit a loud noise in response to the detection of smoke, fire or high levels of carbon monoxide in the exit door unit. The speakers are preferably housed in the door frame or door, so that an alarm sounding from the speakers will direct individuals to the escape door. Preferably, the speakers are inset into the door frame and are only visible when the door is open. The speakers are preferably in communication with the alarm circuitry and an alarm is sounded when an emergency is detected.

In a preferred embodiment, the automatic locking and unlocking mechanism is housed in the escape door structure. Preferred methods of automatically unlocking the door include using a solenoid bolt or other known methods for unlocking a lock with a signal. Preferably the automatic locking and unlocking mechanism is in communication with the alarm circuitry and unlocks the door when an emergency is detected.

The escape door structure is preferably equipped with an automatic door opening mechanism. The automatic opening mechanism preferably comprises a spring or other biasing means acting between the door and the door frame to open the door automatically when it is unlocked. Preferably, the opening mechanism automatically opens the door in an emergency.

In other preferred embodiments, the emergency exit device is equipped with additional features. Preferably, one embodiment includes a power supply. The power supply maybe one or more rechargeable batteries and an AC adapter, but hardwiring the system to direct house current is preferred. In that way, the system cannot be accidentally or intentionally disabled. A most preferred embodiment would be to provide power from both the direct current of the building and from a backup power supply that would power the system in the event the power is lost or disabled in a fire.

One embodiment preferably provides an escape rope or ladder 6 that may be housed in a hollow portion of the escape door. An embodiment preferably comprises a manual unlocking and opening mechanism for use in case of emergencies not detected by the emergency detection and alert system.

An embodiment preferably includes an automated dialing feature for use with a telephone line to contact emergency personnel. Preferably an embodiment comprises fabricated interior or exterior surfaces that resemble the existing or planned wall surfaces, increasing the aesthetics of the door structure. The exterior surface, for example, may be covered with siding or with an imitation brick covering to resemble the exterior of the building.

A preferred embodiment of the emergency exit device can be used on any floor of a building. Emergency exit devices can preferably be installed in multiple locations in a building and be in communication with one another. Such an arrangement facilitates safe and quick escape from many places in the building. Additionally, rescue personnel may be able to enter a building, by way of one of the escape doors, in a location more advantageous to save lives. Multiple emergency exit devices can preferably be monitored or controlled at a central location by the use of a key pad.

Other preferred embodiments include an emergency exit system and a method for facilitating escape during an emergency. In a preferred method of operation, the emergency detection sensors detect the presence of smoke, excessive heat or fire. The detection sensors preferably communicate with the alarm circuitry, and consequently with the speakers, the lights, and the unlocking mechanism of the escape door structure. Preferably, the speakers sound an alarm, the lights are illuminated, and the escape door is unlocked simultaneously. The automatic opening mechanism of the escape door structure preferably acts to open the escape door automatically, creating a safe escape exit. Individuals hear the alarm and see the lights. They crawl along the ground to avoid breathing in the smoke. They are able to exit the building quickly and safely.

Several preferred embodiments of the invention have been described. Those of skill in the art will recognize that the invention of the present application may readily be used as the basis for designing other structures and systems to provide a method for facilitating the safe exit from a building in the event of an emergency due to smoke, fire, high levels of detectable gases and other emergency situations. As will be apparent to those of skill in the art, combinations and variations of the preferred embodiments are within the scope of the invention, as are additions and modifications to the preferred embodiments.

I claim:

1. An emergency exit system, comprising:

an emergency detection device having alarm circuitry in communication with one or more emergency detection sensors, one or more speakers, and one or more lights; and an escape door pivotally mounted on a frame, wherein the door is equipped with a locking mechanism in communication with the alarm circuitry, wherein the lights are inset in the frame between the door and the frame so the lights are hidden from view by the door when the door is closed.

2. The emergency exit system of claim 1, wherein the alarm circuitry is connected to a power supply.

3. The emergency exit system of claim 2, wherein the power supply is an external backup power supply.

4. The emergency exit system of claim 1, wherein the emergency detection sensor comprises a smoke detector, a heat detector, and/or a carbon monoxide detector.

5. The emergency exit system of claim 1, wherein the emergency detection sensors are mounted in the door and/or frame.

6. The emergency exit system of claim 1, wherein the emergency detection sensors are mounted external to the door and/or frame.

7. The emergency exit system of claim 1, wherein the locking mechanism comprises a solenoid bolt connected to the alarm circuitry.

8. The emergency exit system of claim 1, wherein at least one side of the escape door is constructed to appear identical to the adjacent wall.

9. The emergency exit system of claim 1, further comprising an escape rope or ladder stored in a hollow compartment in the escape door.

10. The emergency exit system of claim 1, wherein the escape door is mounted in an exterior wall.

11. The emergency exit system of claim 1, wherein the escape door is located near the floor.

12. The emergency exit system of claim 1, wherein the emergency detection system is mounted in a location removed from the escape door.

13. The emergency exit system of claim 1, wherein the alarm circuitry is in communication with a phone line, and is programable to call emergency personnel.

14. The emergency exit system of claim 1 wherein the alarm circuitry is in communication with one or more similar emergency exit devices located in the building.

15. The emergency exit device of claim 1, further including a control key pad, wherein the alarm circuitry is in communication with the control keypad.

16. An emergency exit unit comprising:

an emergency detection device having alarm circuitry in communication with an escape door pivotally mounted on a frame near or at the level of the floor of a room in a building which when open provides a passage way to the outside of said building;

wherein said frame has one or more high intensity lights mounted in the door frame and positioned between the frame and the door in communication with said alarm circuitry to provide illumination of the door and door frame when the door is open, wherein said door and/or frame have one or more speakers in communication with said alarm circuitry to provide an audible alarm.

17. The emergency exit system of claim 16, wherein said system is located in a residential house, apartment or townhouse.

18. The emergency exit unit of claim 16, wherein the door has an automatic opening mechanism that opens the door automatically when the door is unlocked and the door is pivotally mounted to open in a downward direction.

19. The emergency exit unit of claim 16, wherein the frame has light inset in the frame so the lights are hidden from view by the door when the door is closed.

20. An emergency exit unit as in claim 16, wherein the frame has speakers inset in the frame so the speakers are hidden from view by the door when the door is closed.

* * * * *